United States Patent [19]

Lai

[11] Patent Number: 4,711,763

[45] Date of Patent: Dec. 8, 1987

[54] SULFIDATION-RESISTANT CO-CR-NI ALLOY WITH CRITICAL CONTENTS OF SILICON AND COBALT

[75] Inventor: George Y. Lai, Carmel, Ind.

[73] Assignee: Cabot Corporation, Kokomo, Ind.

[21] Appl. No.: 942,322

[22] Filed: Dec. 16, 1986

[51] Int. Cl.[4] ..... C22C 30/00

[52] U.S. Cl. ..... 420/585; 420/586; 420/588

[58] Field of Search ..... 420/585, 586, 588

[56] References Cited

U.S. PATENT DOCUMENTS 2,103,500 12/1937 Touceda ..... 420/588
4,050,929 9/1977 Murakami et al. ..... 420/585

FOREIGN PATENT DOCUMENTS 743489 9/1966 Canada ..... 420/585

*Primary Examiner*—L. Dewayne Rutledge
*Assistant Examiner*—David W. Schumaker
*Attorney, Agent, or Firm*—Joseph J. Phillips

[57] ABSTRACT

Disclosed is a sulfidation-resistant alloy. The alloy preferably may contain about 27% each cobalt and chromium, 8% iron, 2.7% silicon and the balance nickel plus normal impurities found in alloys of this class.

The alloy is eminently suitable for applications in high temperature, hostile environments generated by many industrial processes, such as refinery, chemical processing and power generations.

4 Claims, 5 Drawing Figures

ALLOY 6B

ALLOY 188

ALLOY 8727

SULFIDATION-RESISTANT CO-CR-NI ALLOY WITH CRITICAL CONTENTS OF SILICON AND COBALT

INTRODUCTION

This invention relates to corrosion-resistant superalloys that are especially resistant to sulfidation attack; and, more specifically, to a silicon rich, nickel-cobalt-chromium base alloy with a required blend of elements essential to provide superior sulfidation resistance.

BACKGROUND AND PRIOR ART

The outstanding sulfidation-resistant alloy available in the art has been alloy 6B invented by E. Haynes (U.S. Pat. No. 1,057,423) and marketed under the registered trademark STELLITE. STELLITE® alloy 6B is cobalt base and contains about 30% chromium, 4% tungsten, 1.1% carbon and is essentially free of iron and nickel.

The high cost and strategic limitations of cobalt prevent the full marketing of the alloy for wide spread use in combating sulfidation damage. The production costs of alloy 6B are especially high because of the difficulty in forging and hot and cold rolling this alloy. Furthermore, it is difficult to fabricate the alloy into components such as heat exchangers for applications.

U.S. Pat. Nos. 4,195,987 and 4,272,289 disclose alloys containing iron, nickel, cobalt, chromium and selected metals including lanthanum to increase resistance to high temperature oxidation. A commercial alloy, marketed under the registered trademark HAYNES® alloy 556, is a typical example of this prior art. The alloy normally contains essentially about 18% cobalt, 22% chromium, 3% molybdenum, 2.5% tungsten, 20% nickel, 0.6% tantalum, 0.02% lanthanum and the balance iron with minor contents of nitrogen, manganese, aluminum, carbon and zirconium.

U.S. Pat. No. 3,418,111 discloses Haynes alloy 188, well-known in the art for its resistance to high temperature oxidation. The alloy normally contains about 22% nickel, about 22% chromium, about 14% tungsten, 0.10% carbon, 0.03% lanthanum, and the balance essentially cobalt (about 40%).

Known in the art is UMCo-50 alloy or HAYNES alloy 150. The alloy contains normally about 28% chromium, about 50% cobalt and the balance iron with minor contents of carbon, manganese, and silicon. The alloy has good high temperature properties including stress-rupture and sulfidation resistance.

Many prior art alloys, including those mentioned above, are used as components in industrial installations where resistance to chemical reactions such as oxidation and sulfidation is required. Equally the weldability and thermal stability characteristics must be acceptable.

Each of the prior art alloys provides one or more of the desired characteristics but may be deficient in one or more of the other required characteristics. In some cases an alloy may provide nearly all the desired characteristics but its use may be limited because of the cost of raw materials and processing. Thus, the art is in need of an alloy that provides all of the desired characteristics at a lower cost.

OBJECTS OF THE INVENTION

It is the primary object of this invention to provide an alloy with a desirable combination of engineering properties, including sulfidation resistance, and at a low cost.

It is another major object of the invention to provide an alloy containing a limited content of strategic materials, for example, cobalt and tungsten.

Still other objects will be obvious or will become apparent from the following descriptions of the invention and various embodiments.

SUMMARY OF THE INVENTION

In accordance with the present invention, the above objectives and advantages are obtained by carefully controlling the composition of the nickel-cobalt-chromium alloy within the ranges set forth in Table 1.

The alloys of this invention may be readily produced by metallurgical processes well-known in the art. Experimental alloys described herein were (1) produced by vacuum melting then (2) electroslag remelted and finally (3) hot and cold rolled to specimen sizes. No unusual problems were experienced during the preparation of the experimental examples.

TABLE 1

| | ALLOY OF THIS INVENTION COMPOSITION, IN WEIGHT % | | | |
|---|---|---|---|---|
| | Broad Range | Intermediate Range | Narrow Range | Typical |
| Cobalt | 25–40 | 25–35 | 25–31 | 27 |
| Chromium | 25–35 | 25–32 | 25–31 | 27 |
| Iron | up to 20 | up to 15 | 4–15 | 8 |
| Silicon | 2–4.0 | 2.1–3.2 | 2.3–3.2 | 2.7 |
| Molybdenum | up to 8 | up to 4 | up to 2 | .1 |
| Tungsten | up to 8 | up to 4 | up to 2 | .1 |
| Mo + W | up to 12 | up to 6 | up to 3 | .2 |
| Cb + Ta | up to 1 | up to 1 | up to .5 | .15 |
| Aluminum | up to 1.3 | up to 1.3 | up to 1.0 | .1 |
| Titanium | up to 1.3 | up to 1.3 | up to 1.0 | .4 |
| Carbon | up to .2 | up to .15 | up to .15 | .06 |
| Rare Earth | up to .2 | up to .1 | up to .1 | — |
| Zirconium | up to .1 | up to .1 | up to .05 | — |
| Boron | up to .1 | up to .1 | up to .01 | — |
| Manganese | up to 2.0 | up to 1.5 | up to 1 | .5 |
| Nickel plus impurities | Balance | Balance | Balance | Balance |

Molybdenum and tungsten may be present in the alloy as may be required based on the use of the alloy. In applications where certain engineering properties, for example, strength, are required, either or both molybdenum and tungsten may be added to the alloy as is well known in the art.

EXAMPLES AND PREFERRED EMBODIMENTS

Sulfidation Tests

Figure 1:
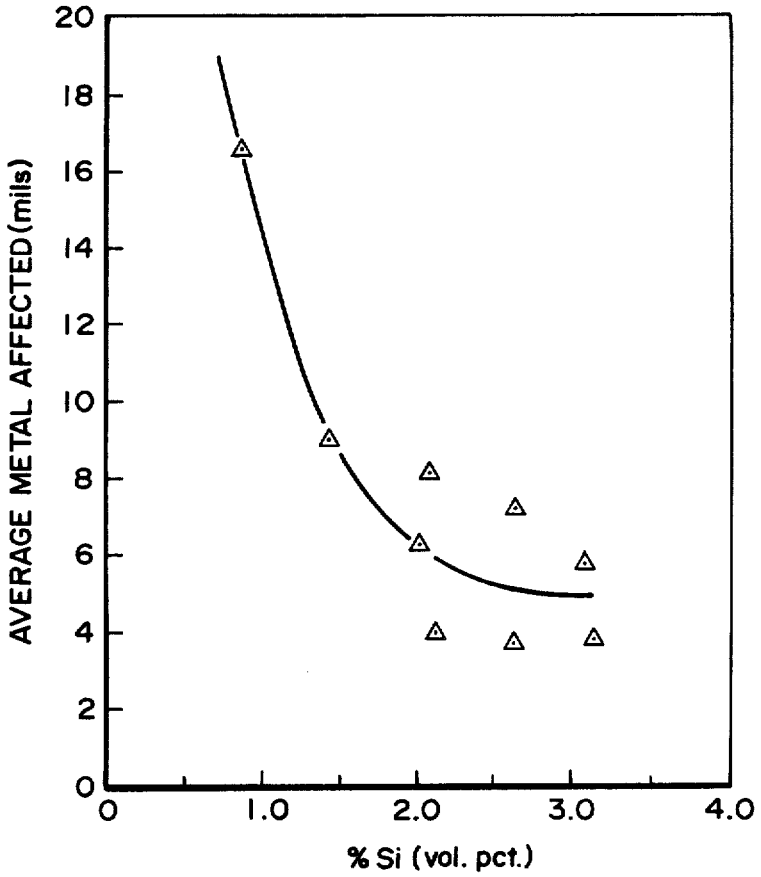
FIG. 1 graphically shows the effect of silicon on the sulfidation resistance of the alloy of this invention.

In a series of experimental alloys, alloy 8727 was prepared as described above. Alloy 8727 consisted essentially of, in percent by weight, 26.5 cobalt, 30.5 chromium, 2.64 silicon, 5.2 iron, 0.33 titanium and the balance essentially nickel.

Long term sulfidation tests were made on alloy 8727 together with the three cobalt-base alloys identified above. The alloys were as follows:

| Alloy | Cobalt Content, % |
|---|---|
| 188 | about 40 |
| 150 | about 50 |
| 6B | about 57 |

Samples of the four alloys were exposed to an enclosed reducing atmosphere with an inlet gas mixture of 5% $H_2$, 5% CO, 1% $CO_2$, 0.15% $H_2S$ and the balance argon.

The test was run for 500 hours at various temperatures: 1400° F., 1600° F. and 1800° F.

Results of the long-term sulfidation tests are shown in Table 2. These data clearly show alloy 8727 is superior in sulfidation resistance over alloys 188 and 150, which were severely disintegrated after 500 hours at the higher temperatures. Alloy 8727 compared favorably with the higher cost alloy 6B.

TABLE 2

| | 500 hour SULFIDATION TEST | | |
|---|---|---|---|
| | Average Metal Affected (mils) | | |
| Alloy | 1400° F. | 1600° F. | 18001F |
| 8727 | 5.5 | 10.4 | 20.9 |
| 188 | 6.1 | >21* | >22* |
| 150 | 8.2 | 14.5 | >30* |
| 6B | 7.9 | 3.0 | 5.7 |

*Samples were consumed during the test.

Series I. Effect of Silicon on Sulfidation

In a series of tests, the alloy of this invention, within the ranges disclosed in Table 1, was prepared with various contents of silicon. This series of experimental alloys was vacuum induction melted in a 25-lb heat and cast to 1¼-inch slabs. The slabs were homogenized at 2050° F. for 2 hours, followed by hot rolling to 0.180-inch sheet at 2050° F. for 10 min. prior to cold rolling to 0.090-inch. The 0.090-inch sheet was then annealed at 2150° F. for 5 min. followed by air cool.

Sulfidation tests were made on this series of alloys to establish the effect of silicon on sulfidation resistance. The sulfidation tests were performed at 1600° F. for 215 hours. Table 3 presents the results of the testing. The results are also summarized in FIG. 1. The average metal affected includes the metal loss plus internal penetration.

The test results indicate that silicon is required to be over at least 2.0% by weight as minimum. The maximum may be up to about 4.0% by weight for uses where maximum sulfidation resistance is required.

TABLE 3

| | Effect of Silicon on Sulfidation Resistance | |
|---|---|---|
| Alloy | Silicon Content in weight percent | Average Metal Affected (in mils) |
| S-1 | .89 | 16.6 |
| S-2 | 1.43 | 9.0 |
| S-3 | 2.02 | 6.3 |
| S-4 | 2.08 | 8.2 |
| S-5 | 2.12 | 4.0 |
| S-6 | 2.63 | 3.7 |
| S-7 | 2.63 | 7.2 |
| S-8 | 3.10 | 5.7 |

TABLE 3-continued

| | Effect of Silicon on Sulfidation Resistance | |
|---|---|---|
| Alloy | Silicon Content in weight percent | Average Metal Affected (in mils) |
| S-9 | 3.14 | 3.8 |

Series II. Effect of Cobalt on Sulfidation

In another series of tests, the alloy described in Table 1 was melted with various contents of cobalt to determine desired composition ranges of cobalt. The alloys were prepared essentially as described in Series I.

Figure 2:
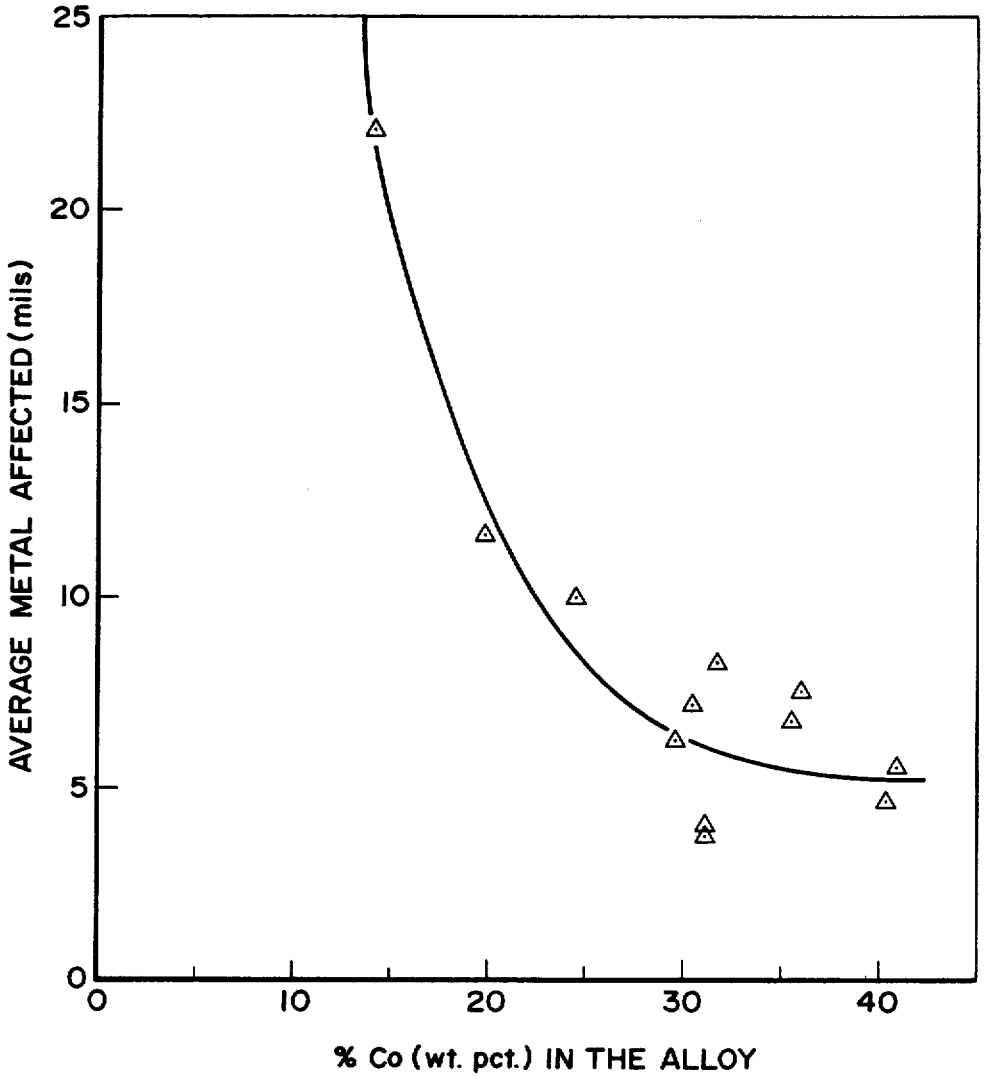
FIG. 2 graphically shows the effect of cobalt on the sulfidation resistance of the alloy of this invention.

The sulfidation tests were made at 1600° F. for 215 hours. Table 4 presents test result data. The data are also summarized in FIG. 2.

The test results show that for maximum sulfidation resistance cobalt must be present over 25%. Increases in cobalt content above 40% do not appear to significantly improve the alloy's sulfidation resistance. Thus, because of the high cost and strategic classification of cobalt, the cobalt content may be less than about 40%, and, preferably, less than about 35%.

TABLE 4

| | Effect of Cobalt on Sulfidation Resistance | |
|---|---|---|
| Alloy | Cobalt Content in weight percent | Average Metal Affected (in mils) |
| C-1 | 14.6 | 22.0 |
| C-2 | 20.0 | 11.5 |
| C-3 | 24.8 | 10.1 |
| C-4 | 29.8 | 6.3 |
| C-5 | 31.9 | 8.2 |
| C-6 | 31.1 | 3.7 |
| C-7 | 31.1 | 4.0 |
| C-8 | 30.5 | 7.2 |
| C-9 | 36.1 | 7.6 |
| C-10 | 35.7 | 6.8 |
| C-11 | 40.6 | 4.7 |
| C-12 | 40.9 | 5.6 |

Series III. Effect of Silicon on Welding

In another series of experimental alloys, the alloy, essentially as described in Table 1, was melted with various contents of silicon to evaluate the welding properties of the alloy.

Bend testing of welded joints was conducted in order to determine the weldability of the alloy. A welded plate sample was prepared by welding two pieces of ½-inch thick plate samples (in the direction parallel to the plate's rolling direction) with a double V-groove weld design using the gas tungsten-arc welding (GTAW) process. Transverse test specimens were cut from the welded plate sample with the weld being perpendicular to the longitudinal axis of the test specimen. The dimensions of the test specimen were ½-inch (thickness)×½-inch (width)×6-inch (length).

Bend testing of welded joints was performed in both face bend and side bend modes. The face bend test involves bending the test specimen with one of the weld surfaces being the tension surface of the specimen.

In the side bend test, the weld was bent so that one of the side surfaces was the tension surface of the specimen. Bending was performed at room temperature with a bend radius of 2 times the thickness of the specimen (i.e., 1-inch).

The bend test data in Table 5 show alloys containing up to about 2.7% silicon are eminently suited for an alloy that must be welded. The data also show that contents over about 3% are not recommended for use in the form of a welded product. However, as shown in the Series I tests, contents over 3% silicon are still suitable for uses that require sulfidation resistance.

TABLE 5

Effect of Silicon on Welding

| Alloy | Silicon Content in weight percent | Bend Test Results* 2T Face Bend | | 2T Side Bend | |
|---|---|---|---|---|---|
| W-1 | 2.69 | P | P | P | P |
| W-2 | 2.74 | P | P | P | P |
| W-3 | 2.70 | P | P | P | P |
| W-4 | 2.72 | P | P | P | P |
| W-5 | 2.70 | P | P | P | P |
| W-6 | 2.68 | P | P | P | P |
| W-7 | 2.70 | P | P | P | P |
| W-8 | 3.26 | P | P | P | F |
| W-9 | 3.29 | F | P | F | F |
| W-10 | 3.26 | F | F | F | F |

*P represents passed test. (The specimen was successfully bent without severe cracking).
F represents failed test. (The specimen suffered severe cracking or complete fracture during bending).

Series IV. Effect of Chromium on Thermal Stability

In another series of experimental alloys, the alloy, essentially as described in Table 1, was melted with various contents of chromium to evaluate the thermal stability of the alloy.

The ½-inch plate samples of 5-inch × 7-inch were aged at 1200°, 1400° and 1600° F. for 1000 hours in air. Transverse Charpy V-notch specimens were prepared. The specimen axis was perpendicular to the plate's rolling direction, and the notch was perpendicular to the surfaces of the plate. Oxide scales and the affected material immediately underneath the oxide scales were machined off during specimen preparation. Charpy impact tests were performed at room temperature to determine the residual impact toughness after thermal aging.

The results of the impact toughness tests on 1000-hour aged samples as well as annealed (unaged) samples are summarized in Table 6. It was shown that the alloy containing about 30% Cr or less exhibits reasonable residual impact toughness. The alloy that contains more than 30% Cr exhibits poor impact toughness, particularly after aging at 1400° and 1600° F. for 1000 hours. Therefore, it is desirable to use alloys containing 30% or less chromium for components that require toughness during long-term, elevated temperature services.

TABLE 6

Effect of Chromium on Thermal Stability

| Alloy | Chromium Content in weight percent | Room Temperature Charpy Impact Toughness* (ft-lbs) Annealed Condition | 1200° F./ 1000 Hrs | 1400° F./ 1000 Hrs | 1600° F./ 1000 Hrs |
|---|---|---|---|---|---|
| T-1 | 26.4 | 134.5 | 46.5 | 42.0 | 57.0 |
| T-2 | 27.3 | 98.5 | 43.0 | 30.0 | 65.0 |
| T-3 | 30.2 | 103.5 | 42.0 | 10.0 | 17.0 |
| T-4 | 31.1 | 115.0 | 27.0 | 3.5 | 4.5 |
| T-5 | 32 1 | 94.5 | 23.0 | 2.0 | 3.5 |

*Each value represents a single test result.

Oxidation Tests

Oxidation tests were performed on alloy 8727, alloy 556, alloy 188, alloy 150 and alloy 6B. The tests were performed at 2000° F. in air for 1008 hours. The alloys were cycled down to room temperature every 24 hours during testing. The test results, shown in Table 7, indicate that all the alloys, except alloy 6B, withstood the oxidation test very well. Alloy 6B was totally consumed during the test.

TABLE 7

OXIDATION TESTS
Oxidation at 2000° F. for 1008 hours

| Alloy | Average Metal Affected* (mils) |
|---|---|
| 8727 | 13.7 |
| 556 | 4.6 |
| 188 | 2.3 |
| 150 | 13.9 |
| 6B | >31.5** |

*Metal affected includes metal loss plus internal penetration.
**Alloy was consumed.

Molten Salt Corrosion

The silicon rich, nickel-cobalt-chromium base alloy of this invention was found to be extremely resistant to corrosion by molten salts such as $V_2O_5$. This type of corrosion attack is also common in high temperature processing environments, in which impurities from fuels or feedstocks reacted at elevated temperatures to form low melting point salts. Vanadium, which is a common impurity in fuels and/or feedstocks, reacts readily with oxygen during combustion to form $V_2O_5$ which is responsible for many corrosion-related materials problems.

Figure 3C:
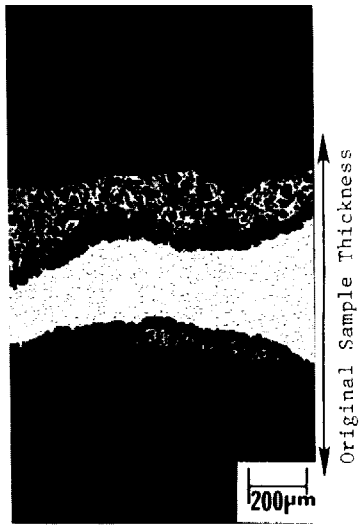
FIGS. 3A, 3B and 3C are optical photomicrographs showing cross sections of three selected alloys after immersion tests in molten $V_2O_5$.
Figure 3B:
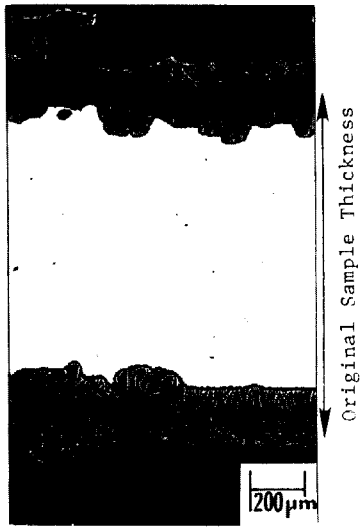
Figure 3A:
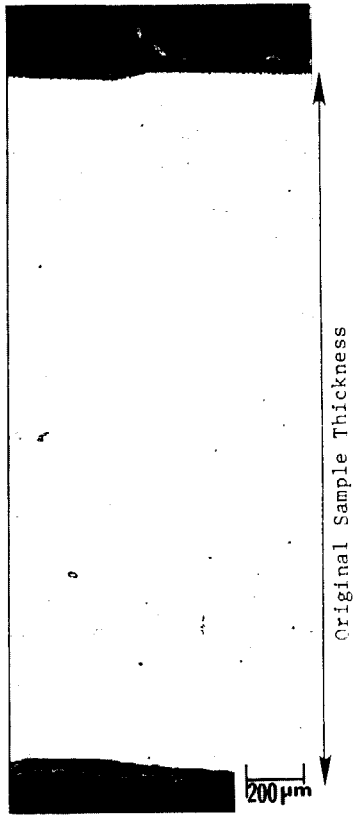

Corrosion tests were performed in crucibles containing $V_2O_5$. Samples of alloy 8727, alloy 188 and alloy 6B were immersed in the molten salt at 1400° F. for 100 hours. The test results are summarized in FIGS. 3A, 3B and 3C. Alloy 8727 showed little attack, while alloy 6B suffered severe attack. Alloy 188 was moderately attacked.

Because the production of the alloy of this invention was relatively trouble-free, it is expected that the alloy may be produced by most well-known processes. Furthermore, because the casting and working characteristics of the alloy of this invention are relatively trouble-free, the alloy may be produced in a great variety of commercial forms including castings, wires, powders, welding and hardfacing products and the like.

It will be apparent to those skilled in the art that the novel principles of the invention disclosed herein in connection with specific examples thereof will support various other modifications and applications of the same. It is accordingly desired that in construing the breadth of the appended claims they shall not be limited to the specific examples of the invention described herein.

What is claimed is:

1. An alloy eminently suited for sulfidation resistance consisting essentially of, in percent by weight, 25 to 40 cobalt, 25 to 35 chromium, up to 20 iron, more than 2 to 4 silver, up to 8 each molybdenum and tungsten but not over 12 molybdenum plus tungsten, columbium plus tantalum up to 1, aluminum up to 1.3, titanium up to 1.3, carbon up to 2, Rare Earth Metals up to 0.2, zirconium and boron each up to 0.1, manganese up to 2, balance nickel plus impurities whereby the critical contents of cobalt and silicon are present to provide improved sulfidation resistance.

2. The alloy of claim 1 containing 25 to 35 cobalt, 25 to 32 chromium, up to 15 iron, up to 4 each molybdenum and tungsten not over 6 molybdenum plus tungsten, up to 1 columbium plus tantalum, up to 1.3 aluminum, up to 1.3 titanium, up to 0.15 carbon, up to 0.1 each Rare Earth Metals, zirconium and boron and up to 1.5 manganese.

3. The alloy of claim 1 containing 25 to 31 cobalt, 25 to 31 chromium, 4 to 15 iron, 2.3 to 3.2 silicon, up to 2 each molybdenum and tungsten but not over 3 molybdenum plus tungsten, up to 0.5 columbium plus tantalum, up to 1.0 aluminum, up to 1.0 titanium, up to 0.15 carbon, up to 0.1 Rare Earth Metals, up to 0.05 zirconium, up to 0.01 boron, and up to 1 manganese.

4. The alloy of claim 1 containing about 27 cobalt, about 27 chromium, about 8 iron, about 2.7 silicon, up to 0.2 molybdenum plus tungsten, up to 0.15 columbium plus tantalum, about 0.5 aluminum plus titanium, about 0.06 carbon, and up to 0.5 manganese.

* * * * *

UNITED STATES PATENT AND TRADEMARK OFFICE

CERTIFICATE OF CORRECTION

PATENT NO. : 4,711,763

DATED : December 8, 1987

INVENTOR(S) : George Y. Lai

It is certified that error appears in the above-identified patent and that said Letters Patent is hereby corrected as shown below:

On the title page and in the specification, Sheet 1 of 3, Figure 1 "%Si (vol. pct.)" should read "%Si (wt. pct.)". In the claims, claim 1, Column 6, line 54 "more than 2 to 4 silver" should read "more than 2 to 4 silicon"; line 57 "carbon up to 2" should read "carbon up to 0.2".

Signed and Sealed this

Seventh Day of June, 1988

*Attest:*

*Attesting Officer*

DONALD J. QUIGG

*Commissioner of Patents and Trademarks*